United States Patent [19]

McFee

[11] Patent Number: 4,645,197

[45] Date of Patent: Feb. 24, 1987

[54] BOUNCE BOARD EXERCISER

[76] Inventor: Richard McFee, Rt. 1, Box 172, Union Springs, N.Y. 13160

[21] Appl. No.: 654,857

[22] Filed: Sep. 26, 1984

[51] Int. Cl.[4] ..... A63B 5/08

[52] U.S. Cl. ..... 272/65; 272/130; 272/136; 272/142; 272/DIG. 6

[58] Field of Search ..... 272/65, 70, 72, 73, 272/97, 128, 129, 130, 134–142, 144, DIG. 4, DIG. 6, DIG. 9, 54, 55, 143, 66; 128/25 R; 73/379

[56] References Cited

U.S. PATENT DOCUMENTS

| | | | |
|---|---|---|---|
| 2,201,036 | 5/1940 | Guerrier | 272/55 |
| 2,261,172 | 11/1941 | Maxwell | 272/142 X |
| 2,903,263 | 9/1959 | Ross | 272/54 |
| 3,062,542 | 11/1962 | Evancha | 272/130 X |
| 3,511,097 | 5/1970 | Corwin | 272/DIG. 6 X |
| 3,511,500 | 5/1970 | Dunn | 272/130 |
| 3,628,791 | 12/1971 | Oarcia | 272/70 |
| 3,638,940 | 2/1972 | Mehaulic | 272/70 |
| 3,744,480 | 7/1973 | Gause et al. | 272/DIG. 6 |
| 3,814,420 | 6/1974 | Encke | 272/66 |
| 3,831,935 | 8/1974 | Hölfe | 272/97 |
| 3,874,656 | 4/1975 | Wintersteller | 272/97 |
| 3,970,302 | 7/1976 | McFee | 272/130 |
| 3,984,666 | 10/1976 | Barron | 272/73 X |
| 4,254,950 | 3/1981 | Baumann | 272/130 |
| 4,452,447 | 6/1984 | Leplet et al. | 272/130 X |
| 4,470,597 | 9/1984 | McFee | 272/144 X |

FOREIGN PATENT DOCUMENTS

| | | | |
|---|---|---|---|
| 23115 | 2/1906 | Austria | 272/97 |
| 8400496 | 2/1984 | PCT Int'l Appl. | 272/72 |

*Primary Examiner*—Richard J. Apley
*Assistant Examiner*—Robert W. Bahr
*Attorney, Agent, or Firm*—Kenyon & Kenyon

[57] ABSTRACT

The exerciser consists of a platform suspended on springs and connected to adjustably connected to shock absorbers for dissipating energy. The assembly is constructed to have a resonant frequency which matches the tempo of bouncy popular tunes and remains the same regardless of the weight of the user: The user first sets his weight and then makes the platform oscillate by flexing his knees and by exerting pressure on a handle which moves in synchronism with, but oppositely to, the platform. The unit can be constructed for use by one or two persons. In one embodiment, the platform is fastened at one end of a lever frame, the other end of which is pivoted. The frame is suspended on elastic springs fastened to a movable sled whose position on the frame is determined by the user's weight. In other embodiments, a compressed coil spring is employed.

26 Claims, 11 Drawing Figures

65
64
62'
67
61
62
66
22
21
20
24
23
63
53
55
56
66'
30
36
54
50
29
26
28
49
32
45
25
40
39
38
46
27
33
31
34
35
37

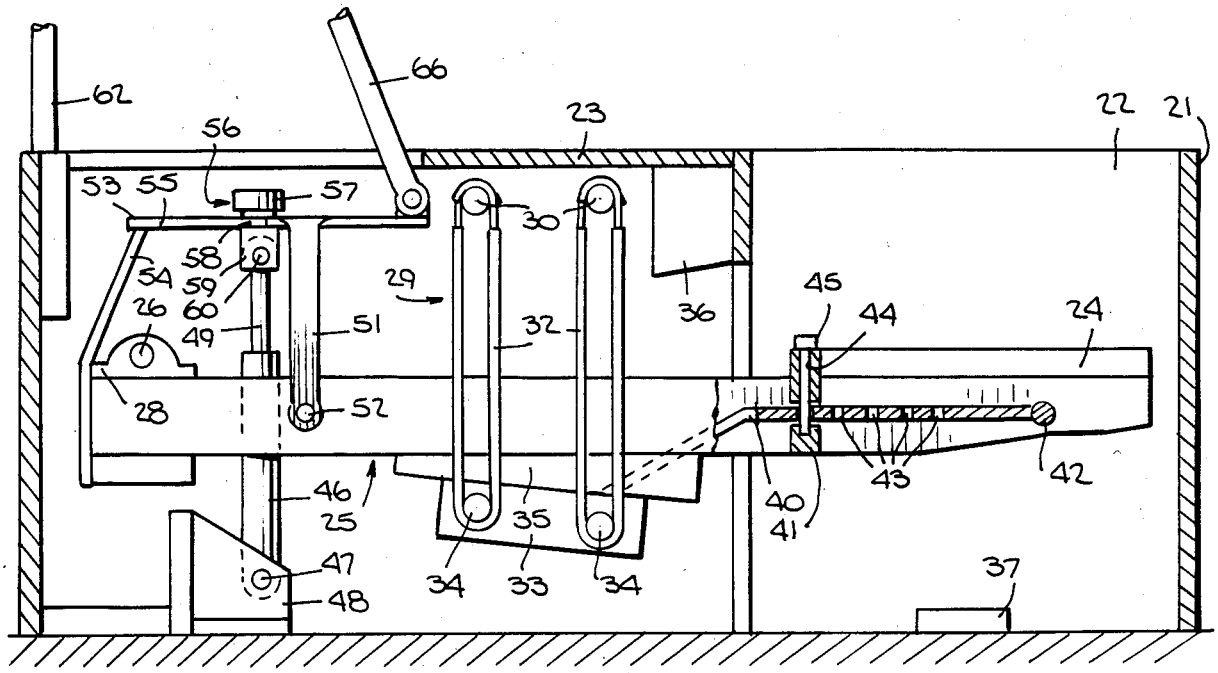
Fig. 4.
Fig. 5.
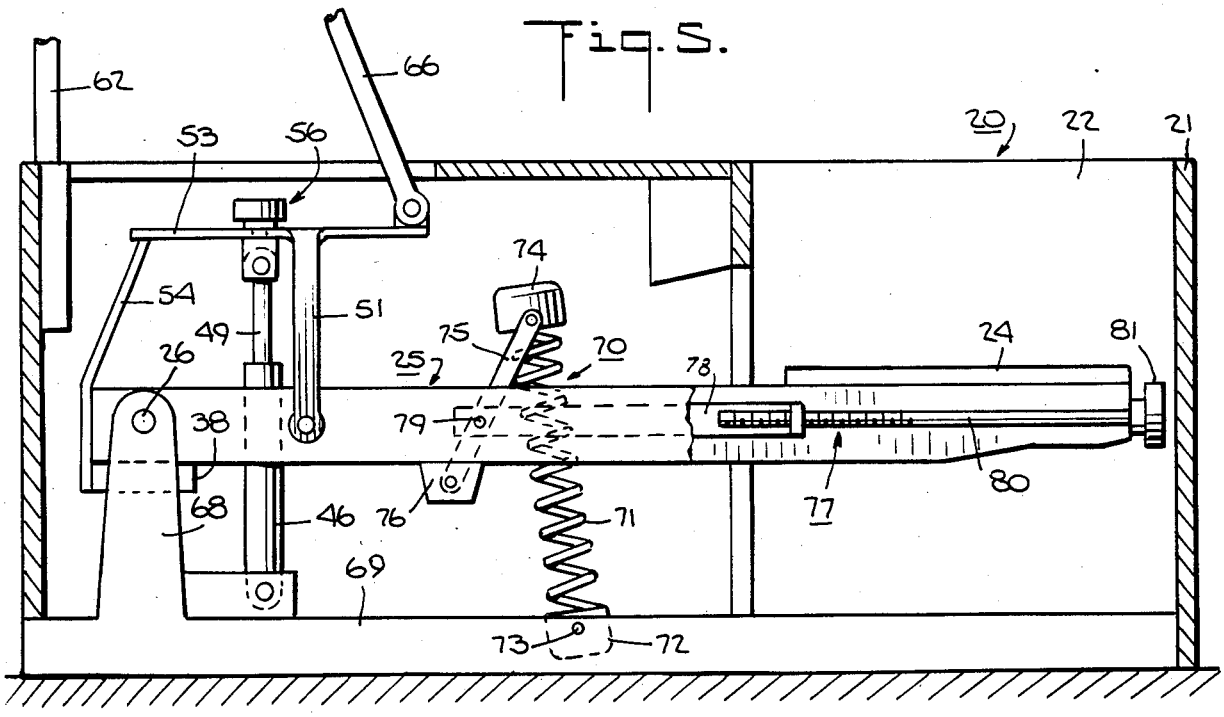

BOUNCE BOARD EXERCISER

This invention relates to an exerciser. More particularly, this invention relates to a bounce board exerciser.

Heretofore, various types of exercisers and exercise machines have been known for strengthening and improving various parts of a human body. In many cases, the exercisers have been constructed to be utilized in exercise programs for stimulating the heart rate and breathing rate in order to increase sense of well-being and decrease the likelihood of disease of the circulatory system. Rowing machines and exercise bicycles are widely used exercisers of this "aerobic" type.

Generally, the use of known types of aerobic exercisers has involved a considerable degree of monotony. The exercise is tedious and more than a little self-discipline is required to maintain a regimen of regular workouts. Much less mental effort is required if the effort can be done rhythmically, especially, rhythmically to music in the fashion of "aerobic dancing".

One type of rhythmic aerobic exerciser is the "bouncing board". Exercisers of this type have a platform which moves up and down a definite amount under the weight of a user with the resulting reciprocating motion converted by various means to a rotary motion which, in turn, is delivered to a flywheel. An exerciser of this type is described in U.S. Pat. No. 4,470,597. In operation, the user is able to move up and down with the platform while exerting a greater force when the platform moves down and supplying net energy to the flywheel over a complete cycle. By employing a flywheel, kinetic energy can be provided to lift the user on the platform. In this case, energy losses can be made up by the user by flexing of his knees in motion with the platform and/or exertion of pressure on a hand rail connected to the exerciser. By bending the knees with proper timing, the user can adjust the frequency of oscillation of the platform to match the beat of the music to which he is listening. The chief drawback of the bouncing board is that the mechanism for connecting the flywheel to the platform is complex, heavy and expensive.

Rhythmic exercisers have also been constructed in the manner of a "bounce board", for example with a platform supported by a spring. In these cases, the user, platform and spring form a resonant system which oscilates up and down in the manner of a diving board. Exercisers of this type are described in U.S. Pat. Nos. 4,341,380 and 1,509,750. In addition, such exercisers may have motors with controls for automatic reversing to provide up and down movement of the platform without outside influences.

Still other types of exercisers have been known wherein the motion of an input device by a user is opposed by dynamic braking forces generated, for example by an electrical loading device, for example as described in U.S. Pat. No. 4,261,562.

Bounce board types of rhythmic exercisers that are presently available suffer two major drawbacks. First, the bouncing requires so little effort that the effort is all but negligible. Second, the frequency of the resonant system depends on the weight of the user. Thus, if the spring is such that the frequency matches the beat of a typical bouncy tune (1.0 to 1.3 Hz) when the user is someone who weighs 100 pounds, the frequency will be much too low when the device is used by a person who weighs 200 lbs.

Both bounding and bounce boards can be used while carrying weights in the hands. Thus, the arms and upper torso can contribute substantially to the effort needed to operate the machine so that the entire body is exercised simultaneously, a feature which makes the exercise provided for the cardiovascular system not only more beneficial but also safer. However, this exercise is of a lifting type, rather than of a press-down type, as is received in the use of the arms in swimming.

Accordingly, it is an object of this invention to provide a rhythmic type of aerobic exerciser that can be operated to the beat of music in a pleasurable manner.

It is another object to provide a rhythmic exerciser that is light and simple and inexpensive, thereby being well adapted for use in the home as well as the gym.

It is another object to provide a bounce board type of exerciser which can require a considerable amount of effort to operate, this effort being adjustable over a wide range to suit the degree of physical conditioning of the user.

It is another object of the invention to provide a rhythmic exerciser in which the arms and upper torso are used in a press-down manner thus providing exercise for the entire body and giving the effort a quality similar to swimming.

It is another object of the invention to provide a bounce board type of rhythmic exerciser in which the frequency remains more or less constant regardless of the weight of the user.

It is another object to provide a bounce board type of exerciser which can be used by two persons simultaneously, allowing them to set a rhythm in a collaborative manner.

Briefly, the invention provides a bounce board exerciser which comprises a support, at least one platform which is movably mounted in the support for up and down movement, spring means for supporting the platform and energy dissipation means connected to the platform for dissipating energy delivered thereto in response to a movement of the platform.

In one embodiment, the support is in the form of a housing of elongated box-like shape with only the platform exposed to the exterior of the housing. In this case, a user would step into the housing to mount the platform.

The exerciser is also provided with means for adjusting the spring means relative to the platform in order to maintain the platform at a predetermined elevation for a given load on the platform. This means permits the exerciser to be adjusted to the weight of the user. That is, before standing on the platform, the user may adjust the position of the spring means so that when the platform is subsequently mounted, the platform will settle into a predetermined elevation, for example, a mid-position. For example, where the platform is mounted on a lever frame which is pivotally mounted within the housing, the spring means may be connected to and between the housing and the lever frame while the means for adjusting the spring means operates to move the spring longitudinally of the lever frame so as to change the lever arm of the force applied by the spring against the lever frame. For example, with the spring means connected to the lever frame at a point P a distance B from the pivot and the middle of the platform at a distance A from the pivot, then the mass M′ of the user at point P is easily shown to be $M(A/B)^2$. Thus, M′ will stay constant if B is made proportional to $M^{\frac{1}{2}}$. This gives the unit a constant frequency, but will not necessarily make the platform settle at the mid-level. This is easily dealt with by increasing the compression or elongation of the spring for heavier subjects by an amount adequate to make up the deficit.

Another way to keep the frequency constant is to use a non-linear spring whose spring constant K (for small displacements) increases as the load is increased. This arrangement is less ideal because the frequency then varies with amplitude and the oscillation of the platform is not so smooth.

The exerciser is also provided with a means for adjusting the energy dissipation means in order to vary the amount of energy dissipated thereby. For example, in the embodiment where the platform is mounted on a lever frame, the energy dissipation means may be in the form of a shock absorber connected to and between the housing and lever frame. In this case, the means for adjusting the dissipation means can be of the type to move the point of connection of the shock absorber to the lever frame longitudinally of the lever frame. In this way, the stroke of the shock absorber can be varied and, thus, the amount of energy dissipated thereby.

The exerciser is also provided with a handle assembly which can be removably mounted on the housing. For example, the handle assembly may include a bar which is articulated to a lever frame on which the platform is mounted for pivoting in an opposite direction to the pivoting movement of the lever frame. When the exerciser is not in use, the handle assembly can be removed and stored in a suitable storage area. The exerciser may then be covered over, for example by a table top and used, for example as a piece of furniture.

In another embodiment, the exerciser may be provided with a pair of platforms, for example for use by two persons. In this case, each platform is provided with a separate spring means which are adjustable in the manner of the abovedescribed "solo" exerciser. In this case, the two platforms may be pivotally mounted on a suitable lever frame on a common horizontal axis, for example in side-by-side relation or in a see-saw relation, i.e. at opposite ends of a single lever frame.

In the case of a double or "dual" bounce board exerciser, a single push rod may be articulated to a rocker arm which is pivotally mounted on the support with ends pivotally connected to two shock absorbers. This permits a simultaneous adjustment of the stroke of the two shock absorbers. This single push rod may be pivotally connected to the see-saw frame at a point whose position can be adjusted to alter the stroke.

The exerciser may also be provided with means for measuring the rate at which energy is dissipated in the energy dissipation means. Read-out means may also be connected to the measuring means for displaying a value indicative of the measured rate. For example, where the energy dissipation means is in the form of a hydraulic-piston-cylinder shock absorber, the measuring means can be used to measure the change in stroke or change in length of the shock absorber. In this regard, it is known that in a hydraulic-type shock absorber, the force on the shock absorber forces oil through an oriface. Further, the oriface is of such small cross-sectional area that the flow through the oriface is highly turbulent rather than newtonian with the piston force f and rate of change of length v then related by $f=cv^2$; where c is a constant determined by oriface size and piston diameter. Oil viscosity does not enter into this equation as long as the viscosity is not so high that flow is no longer turbulent. Thus, temperature is no longer involved. With this equation, the rate of energy dissipation W is equal to $cv^3$. In this case, only the rate of change in length (v) need be measured while a suitable circuit is provided to determine $v^3$ and to thereafter average the absolute of this value.

For example, the measuring means may include a potentiometer or variable capacitor for measuring a rate of change of length in the stroke of the shock absorber while emitting a corresponding signal. A differentiator is then able to receive and differentiate the signal while a cubing circuit cubes the differentiated signal. An averager then averages the absolute value of the cubed signal for emission to the read-out means. In this case, the read-out means may be in the form of a meter for reading out values in terms of horsepower, watts or calories per second.

These and other objects and advantages of the invention will become more apparent from the following detailed description taken in conjunction with the accompanying drawings wherein:

FIG. 4 illustrates a view similar to FIG. 2 showing a means for adjusting the spring means in accordance with the invention;

FIG. 5 illustrates a cross-sectional side view of a modified exerciser constructed in accordance with the invention;

Figure 7:
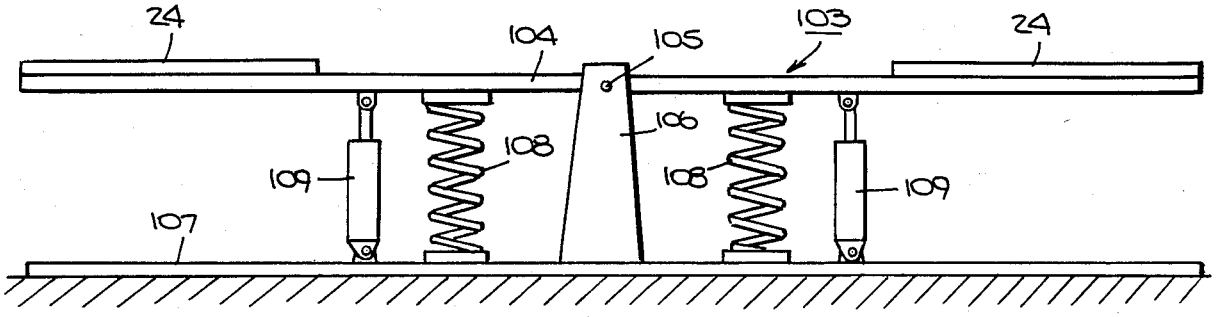
Figure 8:
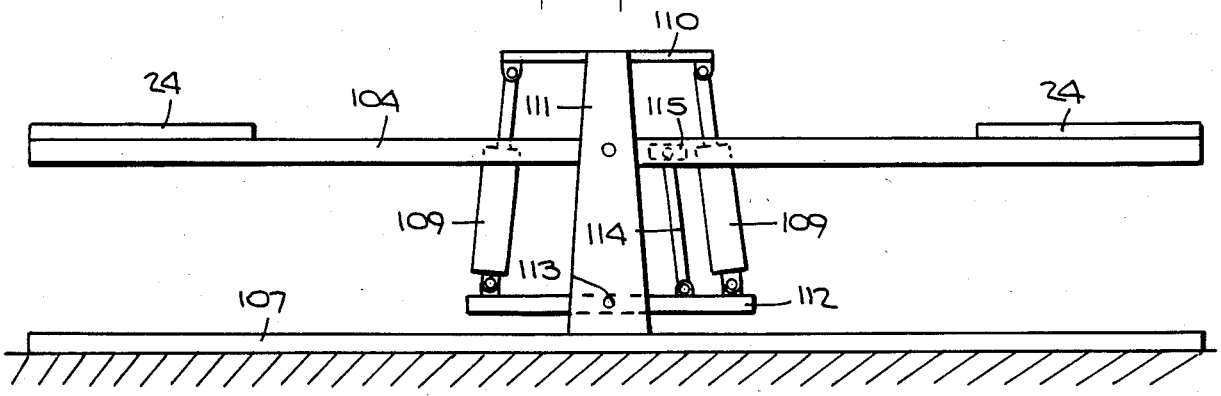
Figure 10:
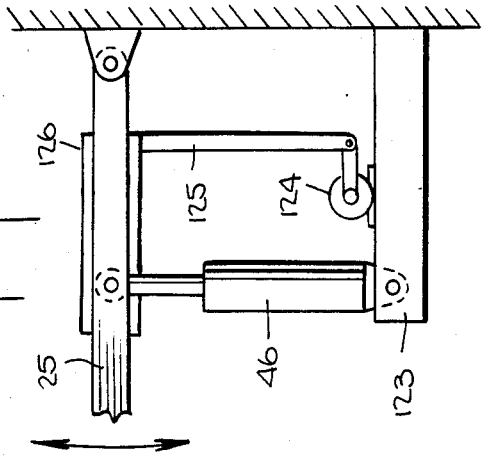
Figure 11:
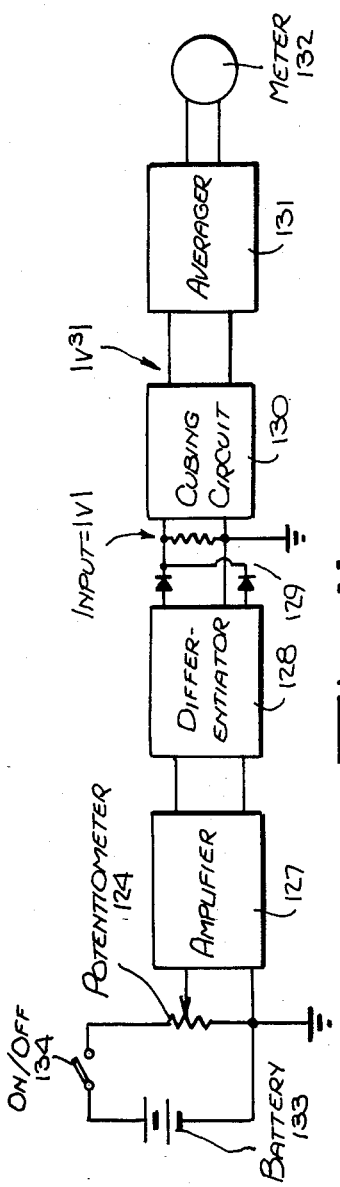
Figure 9:
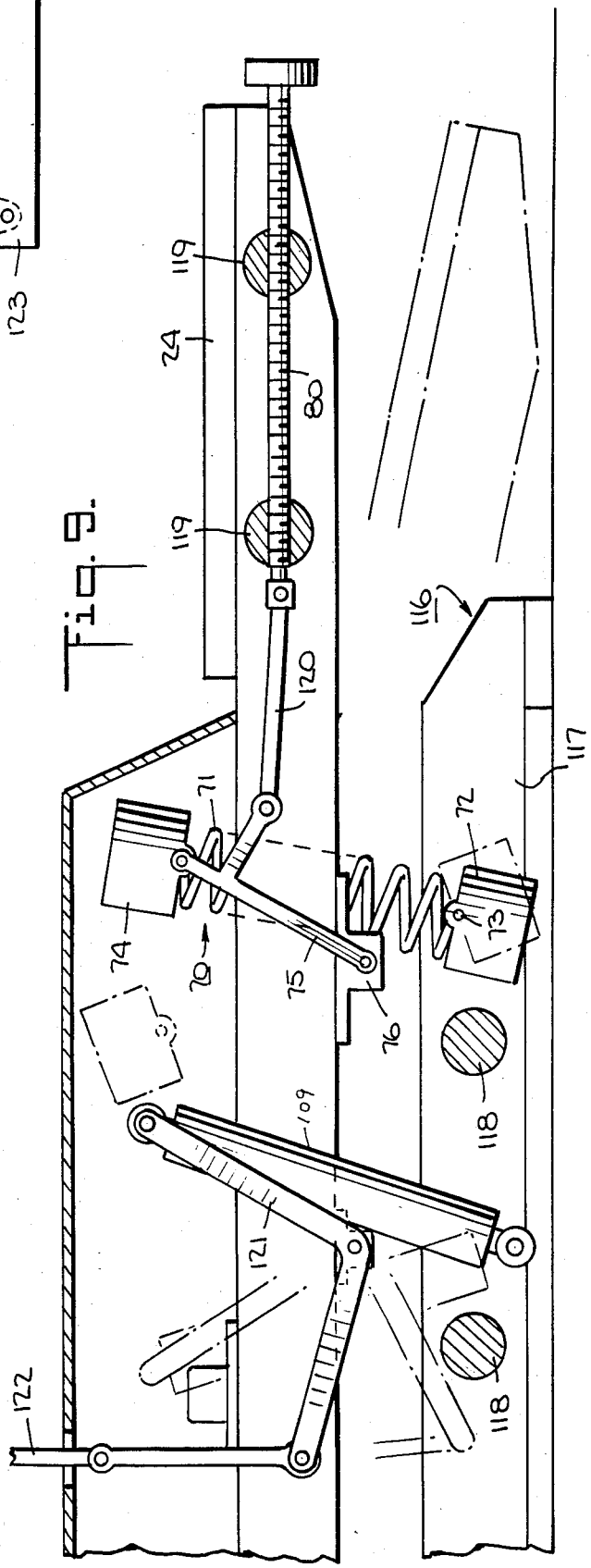

FIG. 7 schematically illustrates a dual bounce board exerciser in accordance with the invention;

FIG. 8 illustrates a modified energy dissipation means for a dual bounce board exerciser in accordance with the invention;

FIG. 9 illustrates a partial view of one-half of a further modified dual bounce board exerciser constructed in accordance with the invention;

FIG. 10 schematically illustrates a means for measuring the rate of energy dissipation in accordance with the invention; and FIG. 11 illustrates a circuit diagram of the measuring means of FIG. 10 connected to a read-out means.

Figures 1, 2:
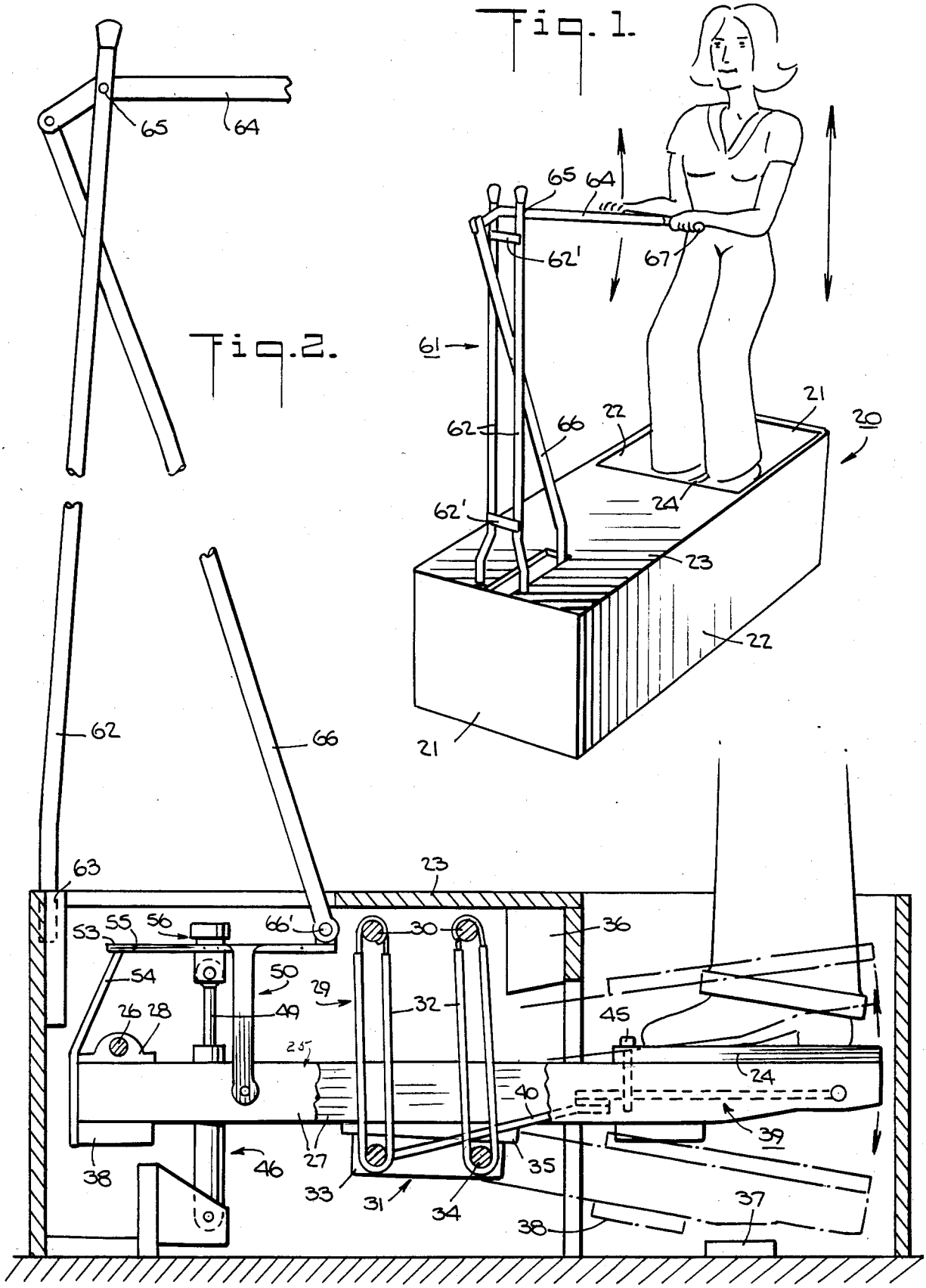
FIG. 1 illustrates a perspective view of an exerciser constructed in accordance with the invention.
FIG. 2 illustrates a cross-section side view of the exerciser of FIG. 1.

Referring to FIG. 1, the bounce board exerciser includes a support in the form of a housing 20 of elongated-box like shape which is provided with a pair of end walls 21, a pair of side walls 22 and a removable cover 23, which is disposed over approximately one half of the housing 20. The housing 20 may be made of wood or any other suitable materials. The end wall 21 next to the user is removable.

Figure 3:
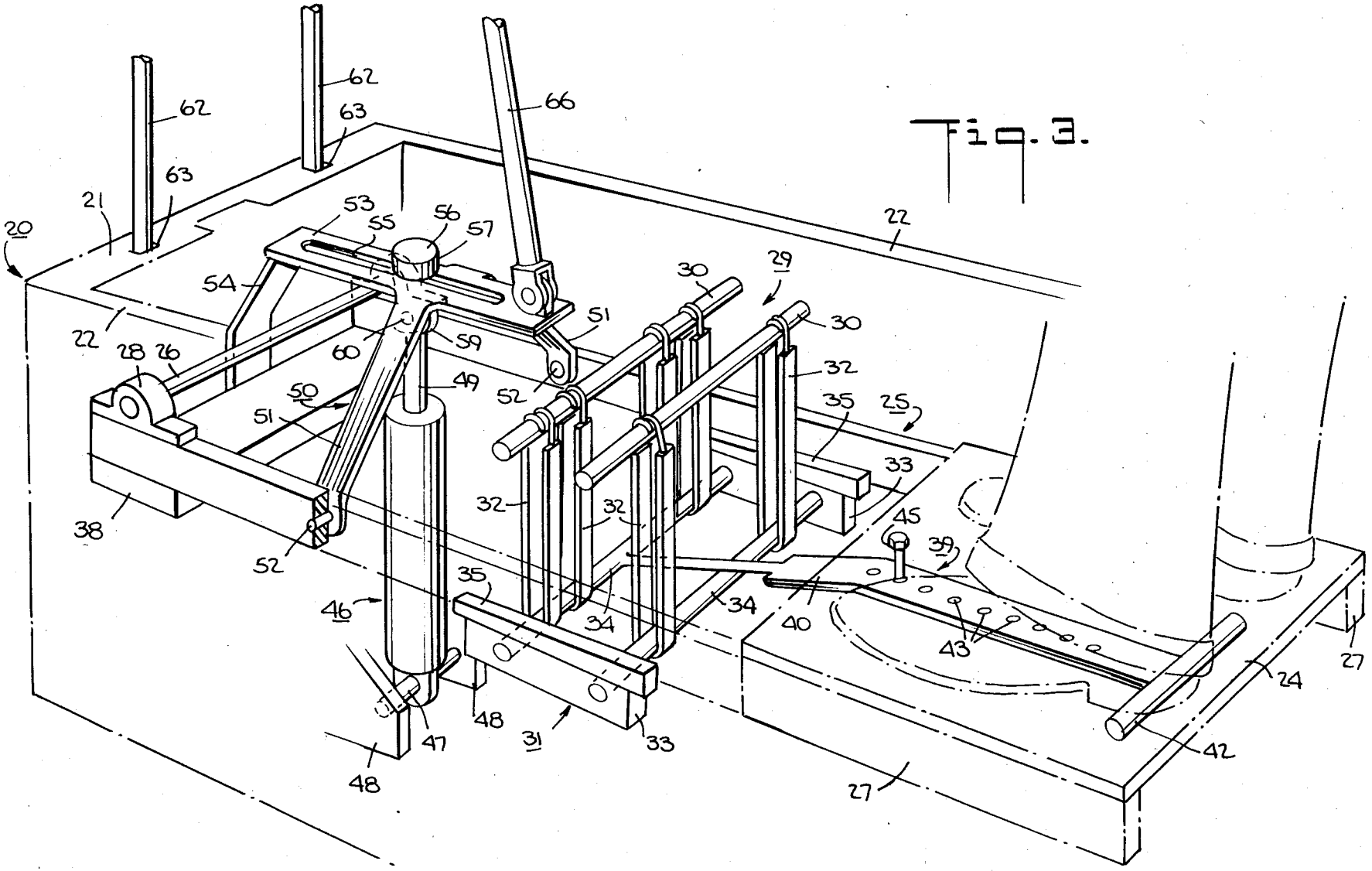
FIG. 3 illustrates a perspective view of the interior of the housing of the exerciser in accordance with the invention.

The exerciser also has a platform 24 movably mounted within the housing 20 for up and down movement. As shown in FIG. 2, the platform 24 is secured to a lever frame 25 which is pivotally mounted at one end within the housing 20 on a pivot shaft 26. As shown in FIG. 3, the platform 24 is of square or rectangular shape while the lever frame 25 is formed of a pair of rails 27 which extend from under the platform 24 to bearing mounts 28 which are pivotally mounted on the shaft 26. As indicated, the shaft 26 is fixedly mounted in the side walls 22 across the width of the housing 20.

Referring to FIGS. 2 and 3, the exerciser also has spring means 29 within the housing 20 for supporting the platform 24 from the housing 20. As shown, the spring means 29 includes a pair of rods 30 which are secured to and which extend across the side walls 22 of the housing 20, a sled 31 which extends under the rails 27 of the lever frame 25 and two rows of springs 32 which extend between the rods 30 and sled 31. The sled 31 is formed of a pair of runners 33 and a pair of rods 34 which extend across the housing 20 and are fixed in the runners 33. The springs 32 are in the form of elastic loops, such as WARCO Utility Straps, which extend between the rods 30 and the rods 34.

In addition, each runner 33 of the sled 31 is slidably engaged against a ramp 35 which is secured to the underside of the rail 27 of the lever frame 25.

The springs 32 are sized to bias the lever frame 25 and the platform 24 into an uppermost position as illustrated in FIG. 2 against a stop 36 secured to each side wall 22 of the housing 20. A similar stop 37 may also be secured along the bottom edge of each side wall 22 in order to limit the downward movement of the lever frame 25 and platform 24.

Of note, the lever frame 25 may be provided with suitable cross-braces 38 between the rails 27 to impart rigidity to the frame 25.

A means 39 is also provided for adjusting the spring means 29 relative to the platform 24 in order to maintain the platform 24 at a predetermined elevation for a given load on the platform 24. As shown in FIGS. 3 and 4, this means 39 includes a stiff strap 40, for example of metal which is slidably mounted in a suitable guide 41 (FIG. 4) on the underside of the platform 24. In addition, the strap 40 has a narrowed end which is pivotally secured to a rod 34 of the sled 31 and a position control handle 42 secured to the opposite end in order to permit manual movement of the strap 40 relative to the guide 41. In addition, the strap 40 has a longitudinal row of apertures 43 which are aligned with an aperture 44 (FIG. 4) in the platform. The adjusting means 39 also includes a suitable headed pin 45, which extends through the aperture 44 into one of the apertures 43 in the strap 40 so as to fix the strap and, thus, the sled 31 in position.

In order to move the sled 31, the pin 45 is lifted out of the strap 40 and the handle 42 grasped to move the strap 40 forward or backward. This causes the sled 31 to move up or down the ramps 35 so as to reduce or elongate the length of the springs 32. For example, for a heavier weight person, the sled 31 would be moved farther away from the pivot shaft 26 to increase the lever arm and also the distance from the pivot shaft 26. This also elongates the springs 32 thereby increasing the spring force. The springs 32 thus exert a greater moment on the lever frame to bias against the weight of the user.

The strap 40 may alternatively be constructed of two hinged sections in order to adjust to changes in spacings due to the slope of the ramp 35.

Of note, when the user is not on the platform 24, the lever frame 25 is held against the stops 36 by the springs 32.

Referring to FIGS. 2 and 3, the exerciser also has an energy dissipation means 46 in the housing 20 which is connected to the platform 24 for dissipating energy delivered thereto in response to a movement of the platform 24. As illustrated, the energy dissipation means 46 is in the form of a hydraulic shock absorber consisting of a piston and cylinder. This shock absorber 46 is pivotally connected via a pivot pin 47 to a pair of support brackets 48 secured to the housing 20. In addition, a piston rod 49 of the shock absorber 46 is connected to a strut arrangement 50 mounted on the lever frame 25.

As shown in FIG. 3, the strut arrangement 50 includes a pair of angled legs 51 which are fixedly mounted via bolts 52 to the respective rails 27 of the lever frame 25, a central bar 53 which extends between the legs 51 longitudinally of the lever frame 25 and a bar 54 which is fixedly secured between the bar 53 and the cross-brace 38 under the pivot shaft 26. The bar 53 is also provided with an elongated slot 55. Of note, the bar 54 is slightly curved to provide a clearance for the pivoting of the lever frame 25.

Means 56 are also provided for adjusting the shock absorber 46 longitudinally of the bar 53 and, thus, the lever frame 25. This means 56 includes a threaded locking or control knob 57 which has a threaded stem 58 passing through the slot 55 in the bar 53 into a forked member 59 which is connected via a pivot pin 60 to an end of the piston 49.

In order to adjust the shock absorber 46, the control knob 57 is loosened and moved along the bar 53 to a new position and then fixed in that position.

Referring to FIG. 1 and 2, the exerciser also has a handle assembly 61 which is removably mounted on the housing 20. This handle assembly 61 includes a pair of upstanding support struts 62 which are interconnected via cross-braces 62' and which are slidably retained at the lower ends within slots 63 formed in the end wall 21 of the housing 20 as indicated in FIG. 3. In addition, the handle assembly includes a bar 64 which is pivotally mounted on a pivot pin 65 extending across the struts 62 and a link 66 which is pivotally connected to one end of the bar 64 and at an opposite end to the slotted bar 53 via a pin 66' within the housing 20 to which the shock absorber 46 is connected. The free end of the bar 64 carries a transverse handle 67 which can be manually grasped by a user.

The handle assembly 61 is articulated to the lever frame 25 and platform 24 so that as the platform 24 moves downwardly, the handle bar 64 moves upwardly. Likewise, as the platform 24 moves upwardly, the handle bar 64 moves downwardly.

In order to use the exerciser 20, the user sets his/her weight before mounting the platform 24 by sliding the sled 31 forward or rearwardly. Next, the user steps onto the platform 24 and stand passively so that the platform 24 settles to a mid-position. In this position, the weight of the user is balanced by the springs 32 and the shock absorber 26 is in a stand-still position. Thereafter, the user drives the platform 24 by flexing of his/her knees. Where the handle assembly 61 is used, the user may also grasp the handle 67 to effect an up and down movement of the platform 24. Movement of the arms up and down also helps to supply energy to the dissipation means, i.e. shock absorber 46. The overall action of the body is then not unlike swimming doing the breast stroke with a porpoise kick. Continued "bouncing" on the platform 24 causes the user to work against the shock absorber 46 so that work is performed.

Use of the vertically oscilating platform furnishes good exercise. In this respect, the large muscle masses in the buttocks and thighs supply most of the power but the muscles of the back and of the arms and shoulders are also subjected to work.

Referring to FIG. 5 wherein like reference characters indicate like parts as above, the exerciser may be modified so that the lever frame 25 is mounted on a pair of supports 68 which extend upwardly from a floor 69 of the housing and in which the pivot shaft 36 is mounted. In addition, the spring means 70 may be formed with a single coil spring 71 which is pivotally mounted via a bottom spring cup 72 with side pins 73 to the floor 69 of the housing 20 and via a top spring cup 74 and link 75 to the lever frame 25. As shown, the link 75 is pivotally connected to the cup 74 and to pivots 76 located on supports fastened under the side rails 27.

In this embodiment, the means 77 for adjusting the spring 71 includes a slider 78 which is connected at one end to the link 75 via a pivot pin 79 and which is slidably guided within the lever frame 25 by suitable means (not shown). In addition, a threaded rod 80 is threaded into the slider 78 and is rotatably mounted within the lever frame 25 with a control knob 81 exposed at the end of the lever frame 25. By turning the knob 81, the rod 80 rotates so as to move the slider 78 forward or rearwardly. This motion, in turn, pivots the link 75 on the pivots 76 so as to vary the length of the lever arm on which the spring acts and also to elongate or shorten the spring 71.

Figure 6:
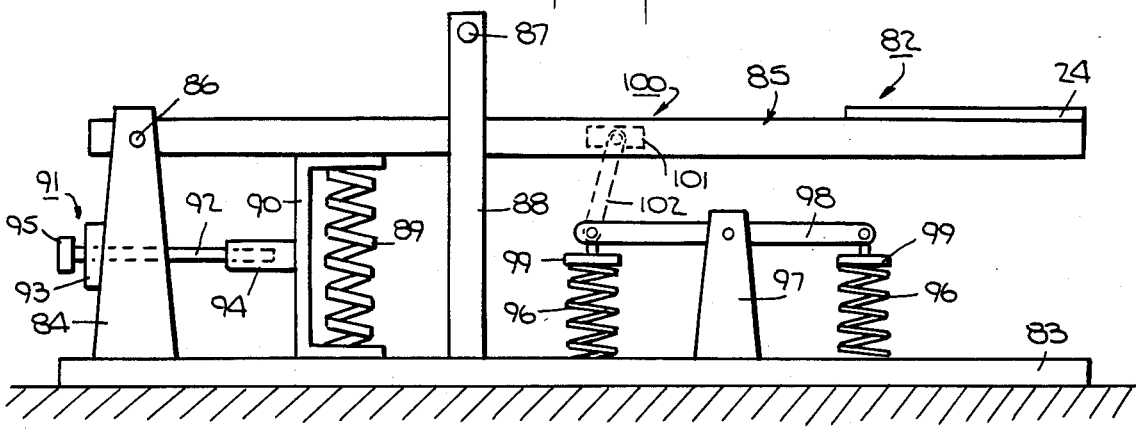
FIG. 6 illustrates a further modified exerciser employing a constant force spring in accordance with the invention.

Referring to FIG. 6, the exerciser 82 may be further modified. To this end, the exerciser 82 has a support 83 on which a pair of support brackets 84 are mounted so as to pivotally support a lever frame 85 on a pivot shaft 86. A suitable stop 87 may also be provided by a crossbar which is mounted in a pair of upstanding supports 88 secured to the support 83. In addition, a compressed compression spring 89 is disposed between the lever frame 85 and the support 83 in order to bias the lever frame 85 against the load on a platform 24 on the lever frame 85. As shown, the spring 89 is compressed within a vertically collapsible frame 90, for example of U-shaped cross-section. In addition, a means 91 is also provided for adjusting the spring 89 relative to the lever frame 85, that is, by moving the spring 89 longitudinally of the lever frame 85. This means 91 includes a threaded shaft 92 which is rotabably mounted in a guide 93 secured to the support brackets 84 and which is threaded into an outstanding stem 94 on the spring frame 90. A suitable control knob 95 is mounted on the exposed end of the shaft 92 so that turning of the knob 95 causes turning of the shaft 92 and thus movement of the spring frame 90 and spring 89 longitudinally relative to the lever frame 85.

In addition, a pair of springs 96 are disposed on opposite sides of a bracket 97 with each spring 96 being secured to the support 83 at the lower end and to a rocker arm 98 which is pivotally mounted on a support 97. As indicated, each spring 96 has a cap 99 at the upper end which is pivotally connected to an end of the rocker arm 98.

A means 100 is also provided for adjusting the amount of motion of the springs 96 produced by motion of the lever frame 85. This means 100 includes a slider 101 which is slidably mounted within the lever frame 85 and a link 102 which is pivotally connected to the slider 101 and to one end of the rocker arm 98. A suitable means (not shown) is also provided for moving the slider 101 along the lever frame 85.

In use, the compressed spring 89 is under compression at all times and the amount of compression is varied only slightly. Hence, the force of the spring 89 is nearly constant and the torque exerted on the lever frame at a given setting of the knob 95 is substantially constant. The springs 96 operate as push/pull springs with the location of the slider 101 determining the amplitude of the spring compression and, hence, the effective spring constant and the frequency. For example, the position of the slider can be controlled by a rack (not shown) moved by a gear attached to a vertical rod (not shown) with a knob at the top. The user may turn this knob while bouncing up and down to thereby control the frequency.

Referring to FIG. 7, the exerciser 103 may also be constructed as a dual bounce board. In this case, a single lever frame 104 is pivotally mounted about a horizontal axis 105 on a pair of brackets 106 secured to a support 107. In addition, spring means such as a pair of coils springs 108 is connected between and to the lever frame 104 and support 107 on opposite sides of the axis 105. Also, dissipation means such as a pair of shock absorbers 109 is pivotally connected at one end to the support 107 and at an upper end to the lever frame 104.

As indicated, with users on each platform 24, a seesaw motion can be imparted to the lever frame 104 while working against the shock absorbers 109. In this embodiment, the platforms 24 are coupled together so that as one rises the other falls.

As above, the springs 108 may be adjusted longitudinally of the lever frame 104 depending upon the weight of the user on that side of the lever frame 24. Likewise, each shock absorber 109 may be adjusted longitudinally of the lever frame 104. Suitable handles may also be provided for use by the users.

Referring to FIG. 8 wherein like reference characters indicate like parts as above, the shock absorbers 109 may be adjusted simultaneously so that the stroke of each is adjusted by a single adjustment. To this end, each shock absorber 109 is pivotally connected at the upper end to a common beam 110 which is secured to and between upstanding brackets 111 on the support 107. In addition, each shock absorber 109 is pivotally connected at the opposite end to a rocker arm 112 which is pivotally connected at a central point via a pin 113 to the supports 111. The means for adjusting the shock absorbers 109 includes a link 114 which is pivotally connected to the rocker arm 112 at one end and to a slider 115 which is slidably mounted within the lever frame 104 at the upper end. By moving the slider 115 in a manner as described above, the stroke of each shock absorber 109 can be adjusted simultaneously.

Referring to FIG. 9, wherein like characters indicate like parts as above, a dual bounce board exerciser may be provided with a base 116 for example having rails 117 and cross-rods 118 in the manner of a ladder. In addition, a lever frame 104 is pivotally mounted within the exerciser above the base 116. In addition, a spring means 70 similar to that described above with respect to FIG. 5 is connected between the lever frame 104 and the base 117. However, in this case, a threaded rod 80 passes through a pair of cross-rods 119 in the lever frame 104 and is connected to the link 75 (which is in the form of a three-legged link) via a lever 120. In this embodiment, rotation of the rod 80 causes longitudinal movement of the rod and lever 120 so that the link 75 is pivoted relative to the lever frame 104 to cause the spring 71 to change the effective length of the spring lever arm and also to elongate or shorten.

A shock absorber 109 is also pivotally connected to the base 116 at a lower end and to a rocker arm 121 at the upper end. As shown, the rocker arm 121 is pivotally connected on the underside of the lever frame 104 and is articulated to an upstanding push rod 122 at a second end. The other half of the exerciser is constructed in similar manner except that the push rod 122 is articulated to both rocker arms 121 so as to adjust both shock absorbers 109. By controlling the vertical position of the push rod 122, the user of the apparatus can control the amount of effort required to operate the apparatus.

Referring to FIG. 10, the exerciser may be provided with a means for measuring the rate at which energy is dissipated from an energy dissipation means used therein as well as with a read-out means connected to the measuring means for displaying a value indicative of the rate measured. To this end, where the energy dissipation means is in the form of a shock absorber 46 connected between a rigid support 123 of the exerciser housing and a pivotal lever frame 25, the measuring means may include a device such as a potentiometer 124 for measuring a rate of change of length in the stroke of the shock absorber 46. In this regard, the potentiometer 124 is fixedly mounted on the support 123 and has a lever arm 125 for abutting a slider 126 on the lever frame 25 which is used to adjust the position of the shock absorber 46 longitudinally of the lever frame 25. In this case, the potentiometer 124 is used to emit a signal proportional to the measured rate of change of length of the stroke of the shock absorber 46.

Referring to FIG. 11, the means for measuring the rate of energy dissipated in the shock absorber 46 employs a circuit, as indicated, wherein the signal emitted by the potentiometer is delivered via an amplifier 127 to a differentiator 128 which receives and differentiates the received signal. In addition, a rectifying circuit 129 is connected to the differentiator 128 to rectify the signal to an absolute value $|v|$ for delivery as an input signal to a cubing circuit 130 which cubes the signal. An averager 131 is connected to the cubing circuit 130 to average the cubed signal for emission to a read-out means such as a meter 132. This meter 132 may display a value indicative of the rate of dissipation of energy in terms of horsepower, watts or calories per second. The circuit may also be powered by a battery 133 and can be activated and de-activated by a suitable on/off switch 134.

Alternatively, various other techniques may be used to measure and display the rate at which energy is dissipated from the energy dissipation means.

The invention thus provides an exerciser which can be constructed for use by a single person or for use by two persons. Further, the invention provides a bounce board exerciser which can be used in rhythmic synchronization with popular bouncy tunes. The spring constants of the springs used are chosen so that the unit has a resonant frequency of the order of 1.1 to 1.2 cycles per second. The user can increase the frequency somewhat by moving in on the platform, and decrease the frequency by standing further out on the platform. A further increase or decrease can be achieved through the use of the handle.

By way of example, in apparatus of the lever arm type, the distance between the pivot and the center of the platform is of the order of 28 inches. The platform may be 14 inches long by 16 inches wide. Shock absorbers suitable for lighter automobiles may be used. These have a stroke length of 5–6 inches. With these smaller diameter shocks, two shocks are needed for each user, as these get quite hot after continued operation. The shocks chosen have roughly the same force during compression and extension (at the same rate). Further, the placement of the working parts of the exerciser within a box-like housing enables the apparatus to be utilized as a piece of furniture when not in use.

The construction of the exerciser is relatively simple and relatively simple components are used.

What is claimed is:

1. A bounce board exerciser comprising a support;

at least one platform for mounting a user thereon movably mounted on said support for up and down movement;

spring means operatively connected to and supporting said platform and balancing the weight of a user thereon; and energy dissipation means connected to said platform for dissipating energy delivered thereto in response to a movement of said platform caused by the user.

2. A bounce board exerciser as set forth in claim 1 which further comprises means for adjusting said spring means relative to said platform to cause said platform to settle at a predetermined elevation for a given load on said platform.

3. A bounce board exerciser as set forth in claim 1 which further comprises a lever frame pivotally mounted at one end on said support and secured to said platform at an opposite end for pivotally mounting said platform relative to said support.

4. A bounce board exerciser as set forth in claim 3 wherein said spring means is connected to and between said support and said lever frame.

5. A bounce board exerciser as set forth in claim 4 which further comprises means for adjusting said spring means longitudinally of said lever frame to cause said platform to settle at a predetermined elevation for a given load on said platform.

6. A bounce board exerciser as set forth in claim 4 wherein said spring means includes at least two transverse rows of springs.

7. A bounce board exerciser as set forth in claim 3 wherein energy dissipation means is connected to and between said support and said lever frame and which further comprises means for adjusting said dissipation means longitudinally of said lever frame.

8. A bounce board exerciser as set forth in claim 7 wherein said dissipation means is a shock absorber.

9. A bounce board exerciser as set forth in claim 1 which further comprises a pair of said platforms, and wherein said spring means is adjustable to cause said platforms to settle at mid-positions thereof when mounted by users.

10. A bounce board exerciser as set forth in claim 9 wherein said platforms are pivotally mounted on a common horizontal axis and which further comprises an adjustable spring means connected with a respective platform and means for adjusting each spring means relative to said respective platform to settle at a predetermined elevation for a given load on said respective platform.

11. A bounce board exerciser as set forth in claim 1 which further comprises a pair of said platforms, a pair of said spring means and a pair of said energy dissipation means, one of said spring means and one of said energy dissipation means being connected to one of said platforms and the other of said spring means and the other of said energy dissipation means being connected to the other of said platforms.

12. A bounce board exerciser as set forth in claim 11 wherein said platforms are pivotally mounted on a common horizontal axis.

13. A bounce board exerciser as set forth in claim 11 which further comprises a lever frame pivotally mounted at an intermediate point within said support, said frame having said platforms mounted at opposite ends thereof.

14. A bounce board exerciser as set forth in claim 13 which further comprises a rocker arm pivotally mounted at an intermediate point within said support and a link pivotally connected at one end to said rocker arm and adjustably mounted on said lever frame at an opposite end and wherein each energy dissipation is a shock absorber connected at one end to said support and at an opposite end to said rocker arm whereby adjustment of said link along said lever frame adjusts the stroke of said shock absorbers.

15. A bounce board exerciser as set forth in claim 1 which further comprises means for measuring the rate at which energy is dissipated in said energy dissipation means and read-out means connected to said measuring means for displaying a value indicative of said rate.

16. A bounce board exerciser comprising a housing;

a platform pivotally mounted in said housing on a horizontal axis to receive a user for up and down movement;

spring means within said housing operatively connected to and supporting said platform in a raised position relative to said housing and for balancing the weight of a user thereon; and energy dissipation means in said housing connected to and between said platform and said housing for dissipating energy delivered thereto in response to a movement of said platform caused by the user.

17. A bounce board exerciser as set forth in claim 16 which further comprises means for adjusting said energy dissipation means so vary the amount of energy dissipated thereby.

18. A bounce board exerciser as set forth in claim 16 wherein said spring means is connected between and to said platform and said housing and which further comprises means for adjusting said spring means to maintain said platform at a predetermined elevation for a given load on said platform.

19. A bounce board exerciser as set forth in claim 18 wherein said energy dissipation means is a shock absorber having a variable stroke and which further comprises means for adjusting said shock absorber relative to at least one of said platform and said housing to vary said stroke.

20. A bounce board exerciser as set forth in claim 19 which further comprises means for measuring the rate of which energy is dissipated in said energy dissipation means and readout means connected to said measuring means for displaying a value indicative of said rate.

21. A bounce board exerciser comprising a support;

at least one platform movably mounted on said support for up and down movement;

a lever frame pivotally mounted on one end of said support and secured to said platform at an opposite end for pivotally mounting said platform relative to said support;

spring means connected to and between said support and said lever frame for supporting said platform;

means for adjusting said spring means longitudinally of said lever frame to cause said platform to settle at a predetermined elevation for a given load on said platform;

means for changing the length of said spring means to vary the pressure force thereof; and energy dissipation means connected to said platform for dissipating energy delivered thereto in response to a movement of said platform.

22. A bounce board exerciser as set forth in claim 21 wherein said means for changing the length of said spring means includes an inclined ramp on said lever frame and a sled connected to said spring means and slidably mounted on said ramp.

23. A bounce board exerciser comprising a support;

at least one platform movably mounted on said support for up and down movement;

a lever frame pivotally mounted at one end of said support and secured to said platform at an opposite end for pivotally mounting said platform relative to said support;

a handle assembly mounted on said support and including a handle bar articulated to said lever frame for moving in an opposite direction to a pivoting movement of said lever frame;

spring means for supporting said platform; and energy dissipation means connected to said platform for dissipating energy delivered thereto in response to a movement of said platform.

24. A bounce board exerciser as set forth in claim 23 wherein said handle assembly is removably mounted on said support and said lever frame.

25. A bounce board exerciser comprising a support;

at least one platform movably mounted on said support for up and down movement;

spring means for supporting said platform;

a shock absorber having a variable stroke connected to said platform for dissipating energy delivered thereto in response to a movement of said platform;

means for measuring the rate at which energy is dissipated in said shock absorber, said measuring means including a device for measuring the change of length in said stroke of said shock absorber and emitting a corresponding signal, a differentiator to receive and differentiate said signal, a cubing circuit to cube the differentiated signal, a rectifier for rectifying said signal from said differentiator and said cubing circuit and an averager connected to said cubing circuit to average the cubed and rectified signal for emission therefrom; and read-out means connected to said averager of said measuring means for displaying a value indicative of said rate in response to said signal from said averager.

26. A bounce board exerciser comprising a support;

at least one platform movably mounted on said support for up and down movement;

spring means for supporting said platform;

energy dissipation means connected to said platform for dissipating energy delivered thereto in response to a movement of said platform; and a handle assembly mounted on said support and including a handle articulated to said platform for moving in an opposite direction to the movement of said platform.

* * * * *